US008103194B2

(12) United States Patent
Patton et al.

(10) Patent No.: US 8,103,194 B2
(45) Date of Patent: Jan. 24, 2012

(54) INK DEVELOPMENT UNITS FOR PRINTERS

(75) Inventors: Forest Sun Patton, San Diego, CA (US); Evgeny Korol, San Diego, CA (US); Eric G Nelson, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 275 days.

(21) Appl. No.: 12/393,004

(22) Filed: Feb. 25, 2009

(65) Prior Publication Data

US 2010/0215405 A1 Aug. 26, 2010

(51) Int. Cl.
*G03G 15/10* (2006.01)

(52) U.S. Cl. ..... 399/237

(58) Field of Classification Search ..... 399/237, 399/249, 53

See application file for complete search history.

(56) References Cited

U.S. PATENT DOCUMENTS

| | | | | |
|---|---|---|---|---|
| 4,272,599 | A * | 6/1981 | Moradzadeh | 430/118.2 |
| 5,323,217 | A | 6/1994 | Christy et al. | |
| 6,141,026 | A | 10/2000 | Domoto et al. | |
| 7,183,026 | B2 * | 2/2007 | Zhu et al. | 430/57.2 |
| 7,421,223 | B2 * | 9/2008 | Jodra et al. | 399/53 |
| 7,481,509 | B2 | 1/2009 | Staelin et al. | |
| 2003/0096186 | A1 * | 5/2003 | Viturro et al. | 430/117 |
| 2007/0297827 | A1 * | 12/2007 | Blaine et al. | 399/98 |
| 2009/0097883 | A1 * | 4/2009 | Guzman et al. | 399/249 |
| 2009/0226839 | A1 * | 9/2009 | Teishev et al. | 430/115 |

* cited by examiner

*Primary Examiner* — David Porta
*Assistant Examiner* — Faye Boosalis

(57) ABSTRACT

An ink development unit is disclosed for liquid electro photography (LEP) printers or the like. An exemplary squeegee on PIP (photo imaging plate) (or "SOP") ink development unit for a liquid electro photography (LEP) printer system includes an ink dispenser configured to dispense ink during a printing operation. A developer roller having a compliant surface is positioned in contact with a PIP during a printing operation. The developer roller directly receives the ink dispensed from the ink dispenser. The developer roller squeegees the ink dispensed from the ink dispenser into an ink layer with higher solids concentration for development onto an image area on the PIP.

16 Claims, 4 Drawing Sheets

INK DEVELOPMENT UNITS FOR PRINTERS

BACKGROUND

Liquid electro-photographic (LEP) printing, sometimes also referred to as liquid electrostatic printing, uses liquid toner to form images on paper or other print media. Liquid toner used in LEP is commonly referred to as ink. LEP is often used for large scale commercial printing. The basic LEP printing process involves placing a uniform electrostatic charge on a photoconductor, the photoconductive surface on a rotating drum for example, and exposing the photoconductor to light in the pattern of the desired printed image to dissipate the charge on the areas of the photoconductor exposed to the light. The resulting latent electrostatic image on the photoconductor is developed by applying a thin layer of ink to the photoconductor. The ink generally consists of charged toner particles dispersed in a carrier liquid. The charged toner particles adhere to the discharged areas on the photoconductor (discharged area development DAD) or to the charged areas (charged area development CAD), depending on the charge of the toner particles, to form the desired image on the photoconductor. The image is transferred from the photoconductor to an intermediate transfer member and then from the intermediate transfer member to the paper or other print medium.

DETAILED DESCRIPTION

Figure 1:
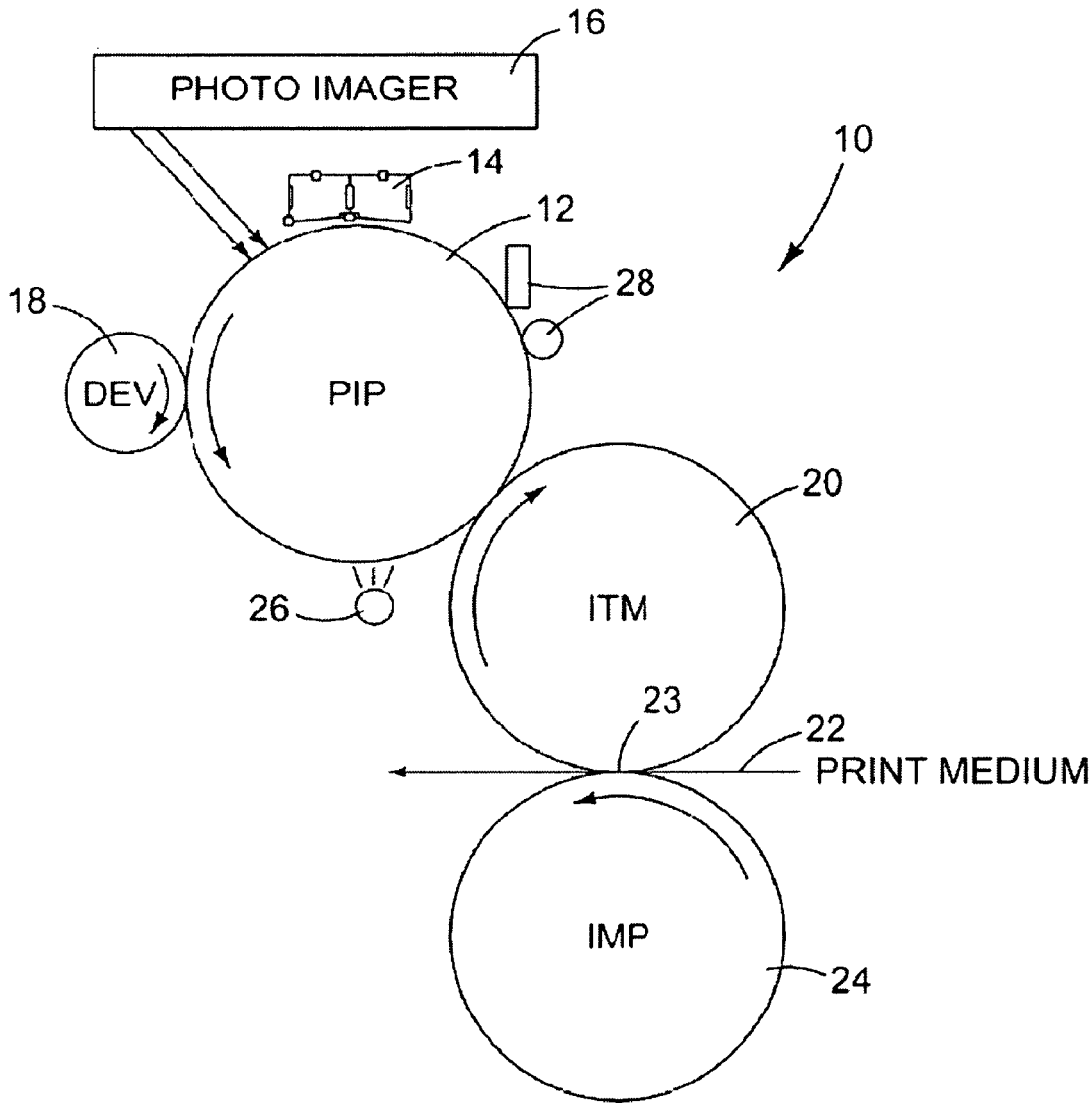
FIG. 1 is a block diagram illustrating the basic components of an LEP print engine.

Exemplary squeegee on a PIP (photo imaging plate) (or "SOP") ink development unit are disclosed which may be implemented in stand-alone printer systems, such as liquid electro photography (LEP) printers. In exemplary embodiments, one or more SOP ink development units may be provided (e.g., one SOP ink development unit for each color). The SOP ink development unit includes an ink dispenser which dispenses ink onto a compliant surface of a developer roller during a printing operation. It is noted that the ink dispenser may take any suitable form, including the ink "jet" shown in the drawings, ink "pan" (not shown), and the like. The developer roller rotates against the PIP with a contact force sufficient to serve as a squeegee to remove excess ink. Thus, the SOP ink development unit transfers a more compacted ink layer with higher solids concentration onto an image area of the PIP for development. Also, embodiments of the new SOP ink development unit may simplify the ink development process by bringing the ink directly to the developer roller near the nip between the developer roller and the PIP, instead of first having to develop the ink on another roller and then having to transport the ink to the developer roller. This simplification results in an ink development unit (the SOP ink development unit) which may be easier to manufacture and less expensive than traditional development units.

Further advantages may also be realized, for example, because there are no gaps which need to be set as there are between the various rollers in a traditional ink development unit, such as the gap between the developer roller and the PIP. In addition, the surface quality of the developer roller is not as large a factor as it is in a traditional ink development unit because in the SOP ink development unit the ink is applied directly to a compliant surface of the developer roller. The compliant surface of the developer roller deforms as it is compressed against the PIP drum to maintain a force at the nip sufficient to squeeze "excess" ink out of the nip. Thus, quality control standards during the manufacturing process may be relaxed, reducing manufacture time and costs. In addition, the compacted ink layer helps more completely transfer to the image area on the PIP even when manufacturing defects are present on the compliant surface of the developer roller, or as surface quality deteriorates over time.

FIG. 1 is a block diagram illustrating the basic components of an LEP print engine 10. In print engine 10 a uniform electrostatic charge is applied to a photoconductive element 12, a thin film of photoconductive material wrapped around the outer surface of a drum for example, by a scorotron, charge roller, or other suitable charging device 14. Photoconductive element 12 used for LEP printing is commonly referred to as a photo imaging plate (PIP). A scanning laser or other suitable photo imaging device 16 exposes selected areas on PIP 12 to light in the pattern of the desired printed image to dissipate the charge on the areas of PIP 12 exposed to the light. In discharge area development (DAD), for example, the discharged areas on PIP 12 form an electrostatic image which corresponds to the image to be printed. This electrostatic image is said to be a "latent" image because it has not yet been developed into a toner image. A thin layer of liquid toner is applied to the patterned PIP 12 using a developer roller 18. Developer roller 18 represents generally an ink development unit described in more detail below.

The latent image on PIP 12 is developed through the application of the ink which adheres to the discharged areas of PIP 12 in a uniform layer of ink on PIP 12, developing the latent electrostatic image into an ink image. The ink image is transferred from PIP 12 to an intermediate transfer member (ITM) 20 and then from intermediate transfer member 20 to print medium 22 as medium 22 passes through a nip 23 between intermediate transfer member 20 and a pressure roller 24. Print medium 22 represents generally any suitable print medium and may be delivered to print engine 10 as a continuous web dispensed from a roll or as individual sheets. Pressure roller 24 is commonly referred to as an impression cylinder (IMP). An LED lamp or other suitable discharging device 26 removes residual charge from PIP 12 and toner residue is removed at a cleaning station 28 in preparation for developing the next image or for applying the next toner color plane.

Figure 2:
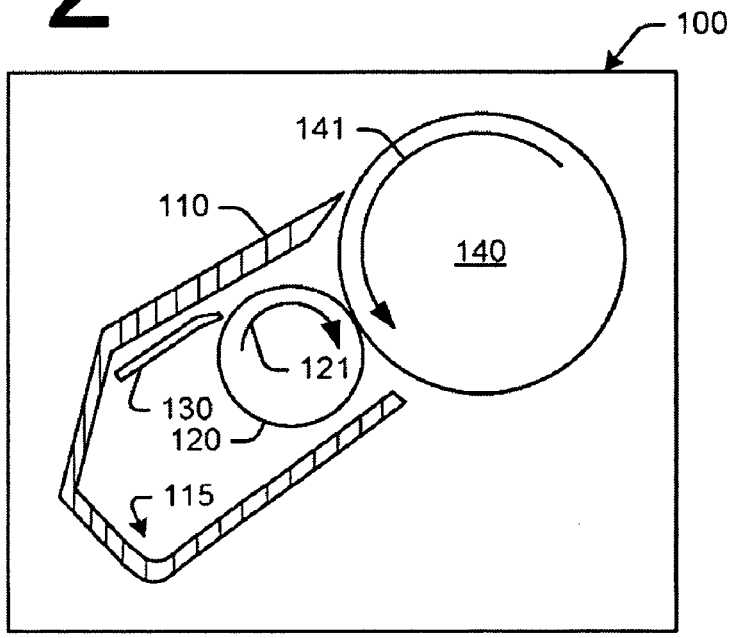
FIG. 2 illustrates one embodiment of a squeegee on PIP (photo imagine plate) (or "SOP") ink development unit.

FIG. 2 illustrates one embodiment of an image developer system 100 including a squeegee on PIP (or "SOP") ink development unit 110. Exemplary image developer system 100, for example, may be part of an LEP color printer, e.g., as described above with reference to FIG. 1.

In an exemplary embodiment, the SOP ink development unit 110 serves as an ink tray 115 to collect excess ink, while also housing a developer roller 120 and ink dispenser 130. The ink dispenser 130 is positioned in the SOP ink development unit 110 such that ink is delivered directly onto a compliant surface 122 of the developer roller 120 during a printing operation (see, e.g., FIG. 2). The SOP ink development unit 110 may be positioned adjacent a photo imaging plate (PIP)

140 for the printing operation so that the developer roller 120 contacts an imagines surface of the PIP 140.

The developer roller 120 may be manufactured as a hollow cylindrical roller having a conductive core. The core may be manufactured of any conductive material, such as, e.g., metal, plastic with one or more conductive layer, and the like. In an exemplary embodiment, the core is formed from one or more of aluminum, stainless steel, cold drawn steels with a coating, etc., and/or combinations thereof The core may also be covered with a layer of a conductive polymeric material. An example is polymeric material incorporating additives such as metal particles, ionic charged particles, carbon black, graphite, etc., and/or combinations thereof In an exemplary embodiment, this layer is formed from a conductive urethane material.

The developer roller 120 may also include a suitable shaft and gear system which may be operatively associated with a drive assembly (not shown) of the printer system. Generally, the drive assembly includes mating gears to effect rotational movement (e.g., in the direction of arrow 121) of the developer roller 120 during a printing operation in which the PIP is also rotated (e.g., in the direction of arrow 141), as is well understood in the printer arts.

Notably missing in the SOP ink development unit 10 are the separate electrode and ink-compacting roller that would otherwise be present in a traditional developer unit. Instead, the developer roller 120 serves both of these functions, and therefore a separate electrode and ink-compacting roller are not necessary. Eliminating these components in the SOP ink development unit 110 reduces part count and the associated cost and failure points, while also increasing the speed at which print jobs may be completed (i.e., by reducing the path from ink dispenser 130 to the imaging surface of the PIP 140).

Before continuing, it is noted that the systems and methods described herein are not limited to any particular printer system.

Figure 3:
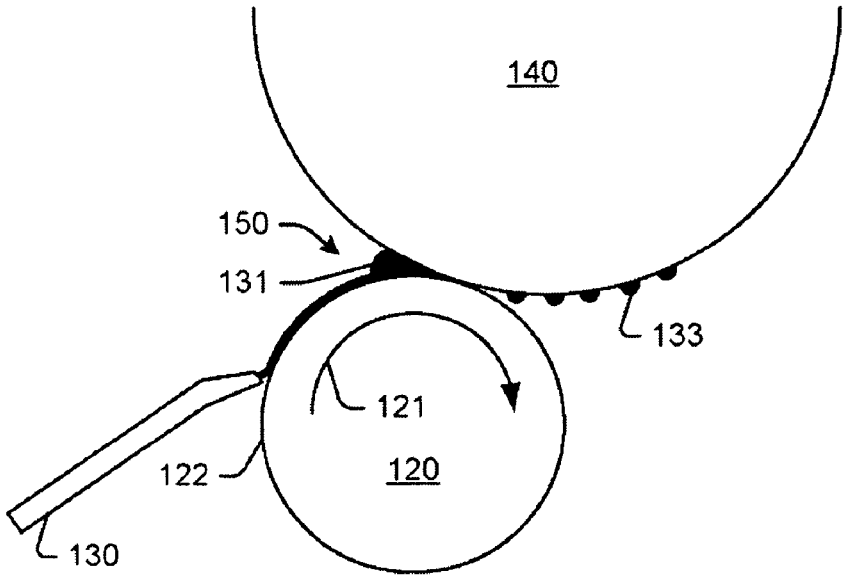
FIG. 3 illustrates the operation of the exemplary SOP ink development unit shown in FIG. 2.

FIG. 3 illustrates the operation of the exemplary SOP ink development unit shown in FIG. 2. During a printing operation, the developer roller 120 is electrically biased (e.g., to about −450 volts). The PIP 140 is also initially charged (e.g., to about −900 volts), then selectively discharged by light exposure on the imaging area.

During a printing operation, the ink dispenser 130 uniformly feeds ink 131 onto the compliant surface 122 of the developer roller 120. The ink travels toward the nip 150 formed between the developer roller 120 and the PIP 140 so that the ink 131 is applied onto the PIP 120. Excess ink 131 is simultaneously squeegeed by the interaction between the developer roller 120 and the PIP 140. Thus, the developer roller 120 regulates the solids ratio in the ink on the PIP 140. Ink develops on the PIP 140 only where the PIP has a discharged image area (e.g., as illustrated in FIG. 2 by ink 133). The excess ink flows out of the nip entrance on the same side where it enters. The result is a compacted ink layer with higher solids concentrations that can be transferred to a blanket for drying and then application to the print medium.

Figure 4A:
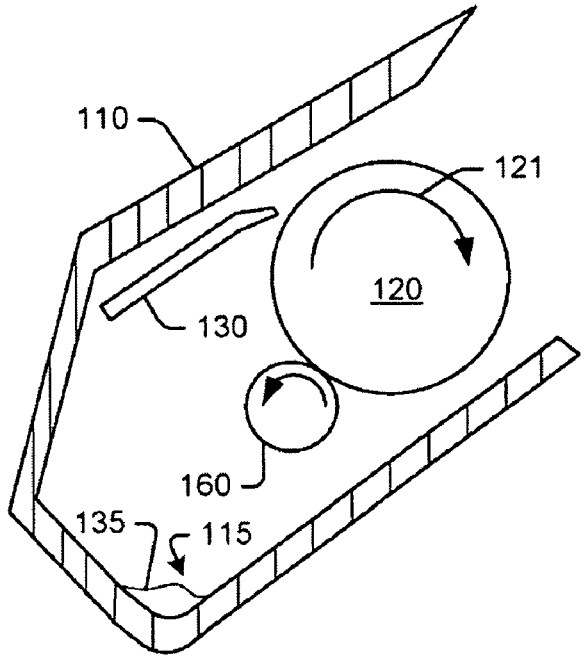
FIG. 4*a-c* illustrate exemplary cleaning, systems which may be provided in an embodiment of an SOP ink development unit.
Figure 4B:
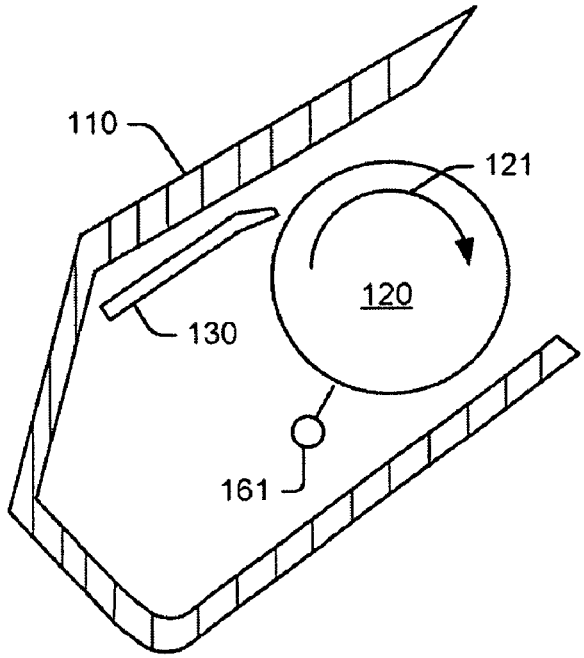
Figure 4C:
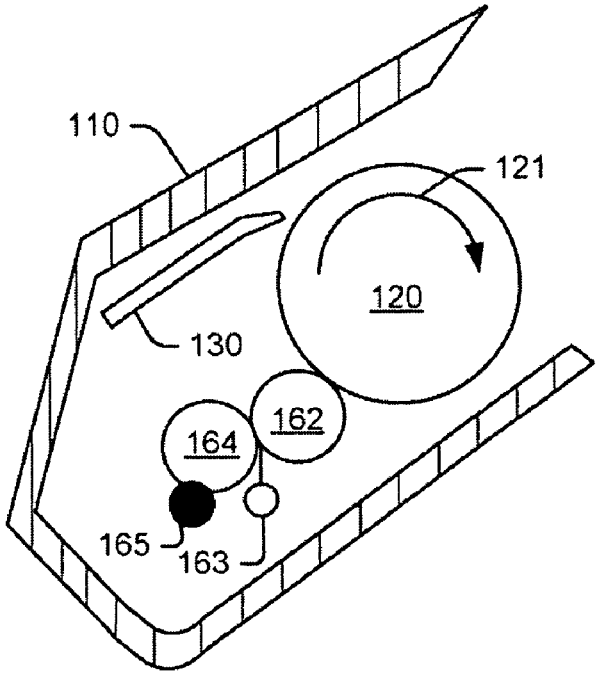

FIGS. 4*a*-*c* illustrate exemplary cleaning systems which may be provided in an embodiment of an SOP ink development unit. The cleaning system may include one or more secondary rollers, sponge rollers, wipers or scrapers, and or any combination thereof.

The exemplary cleaning system shown in FIG. 4*a* includes a secondary roller 160 which contacts the developer roller 120 during a printing operation to remove remaining ink from the developer roller 120. The exemplary cleaning system shown in FIG. 4*b* includes a wiper or scraper 161 which contacts the developer roller 120 during a printing operation to remove remaining ink from the developer roller 120. The exemplary cleaning system shown in FIG. 4*c* includes a combination of secondary roller 162, scraper 163, and sponge roller 164 with associated squeezer roller 165 to "squeeze" excess ink from the sponge roller 164.

This cleaning process, in many instances, may substantially minimize sludge buildup on developer roller 120. In each of these embodiments, the excess ink 135 may collect in the ink reservoir 115 of the SOP ink development unit 110 for recycling, remixing, reuse, or disposal. Thus, contamination of other parts of the printer system by the excess ink is reduced or altogether eliminated.

Figure 5:
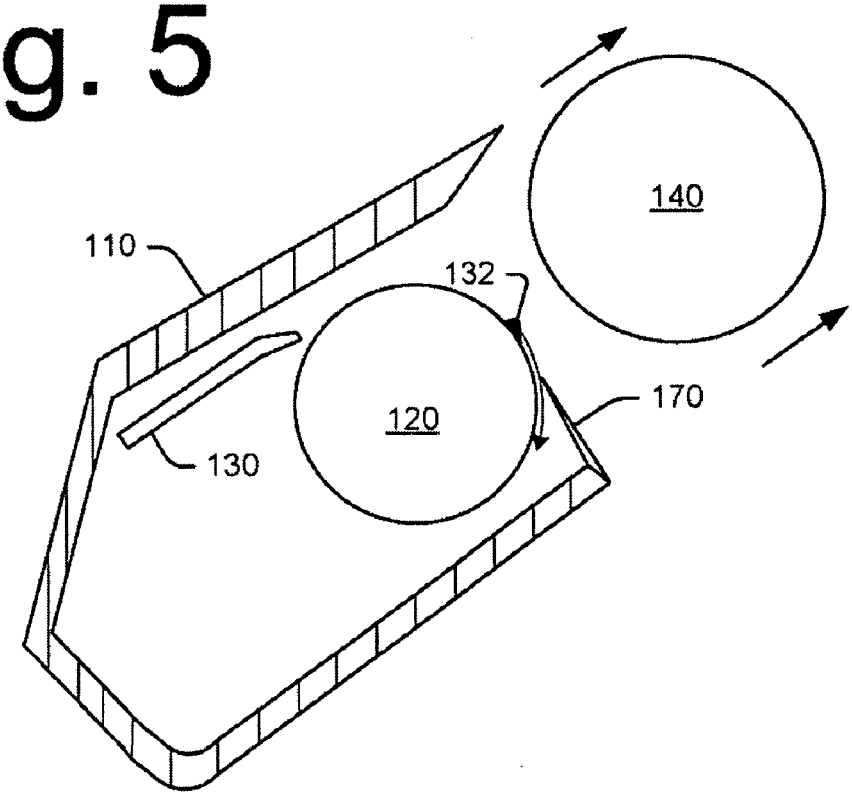
FIG. 5 illustrates an exemplary shield which may be provided in an embodiment of an SOP ink development unit.

FIG. 5 illustrates an exemplary shield which may be provided in an embodiment of an SOP ink development unit. In an exemplary embodiment, the shield 170 is movable so that the shield 170 remains out of the way during printing operations, and then moves upward (e.g., via spring action) to catch the ink during the disengaging process. The shield 170 serves to collect excess ink at the nip formed between the developer roller 120 and the PIP 140 in the event that the SOP ink development unit 110 is retracted from or otherwise removed from contact with the PIP 140.

The exemplary embodiments shown and described herein are provided for purposes of illustration and are not intended to be limiting. By way of example, the cleaning systems are not limited to the particular configurations shown and described herein. It is also noted that the placement of the roller(s) in the SOP ink development unit 110 may also be varied depending on design considerations. Exemplary design considerations include, but are not limited to the cost and size of components, printer throughput, type of ink being used, and so forth.

The invention claimed is:

1. An ink development unit for a liquid electro photography (LEP) printer system, comprising:
   - a developer roller having a compliant surface pressed against a photo imaging plate (PIP) at a nip during a printing operation; and
   - an ink dispenser configured to dispense ink directly on to the developer roller during the printing operation without a separate ink-compacting roller.

2. The ink development unit of claim 1, further comprising a cleaning system positioned adjacent the developer roller to remove the excess ink from the developer roller during the printing operation.

3. The ink development unit of claim 1, further comprising an ink shield positioned adjacent the developer roller to prevent splatter of ink when the developer roller is retracted from the PIP.

4. The ink development unit of claim 1, wherein the compliant surface of the developer roller is pressed against the PIP with sufficient force to squeegee ink upstream away from the nip.

5. A printer system comprising:
   - an ink development unit with an ink dispenser and a developer roller having a compliant surface, the developer roller positioned adjacent the ink dispenser to receive ink directly from the ink dispenser during a printing operation; and
   - a photo imaging plate (PIP) positioned in contact with the developer roller, the developer roller rotating against the PIP with a contact force sufficient to serve as a mechanical squeegee and remove excess ink.

6. The printer system of claim 5, further comprising a cleaning device operatively coupled to the developer roller to remove the excess ink from the developer roller.

7. The printer system of claim 6, wherein the cleaning device includes a scraper and a sponge.

8. The printer system of claim 5, wherein a compacted ink layer with higher solids concentration is transferred for development onto an image area on the PIP.

9. The printer system of claim 5, wherein the developer roller is held at a voltage of about −450 volts to provide a voltage differential between the developer roller and an image area on the PIP.

10. The printer system of claim 5, wherein the developer roller contacts the PIP to completely transfer the compacted ink layer to an image area on the PIP even with defects in surface quality of the developer roller.

11. The printer system of claim 5, wherein developer roller completely transfers the compacted ink layer to an image area on the PIP even as surface quality of the developer roller deteriorates.

12. A liquid electro photography (LEP) printer system with ink development unit, comprising:

a developer roller in the ink development unit;

an ink dispenser in the ink development unit, the ink dispenser applying ink directly onto the developer roller during a printing operation; and a photo imaging plate (PIP) contacting the developer roller during the printing operation, the developer roller serving as a mechanical squeegee to remove excess ink and transfer a compacted ink layer onto an image area on the PIP.

13. The LEP printer system of claim 12, further comprising a cleaning system positioned against the developer roller to remove the excess ink from the developer roller, wherein the cleaning system includes a scraper assembly or a sponge assembly.

14. The LEP printer system of claim 12, further comprising a voltage differential between the developer roller and the image area on the PIP.

15. The LEP printer system of claim 12, wherein the compacted ink layer completely transfers to the image area on the PIP even with defects in surface quality of the developer roller.

16. An ink development unit for a liquid electro photography (LEP) printer system, comprising:

a developer roller having a compliant surface pressed against a photo imaging plate (PIP) at a nip during a printing operation; and an ink dispenser configured to dispense ink directly on to the developer roller during the printing operation, wherein the compliant surface of the developer roller is pressed against the PIP with sufficient force to squeegee ink.

* * * * *